US008269676B2

(12) United States Patent
Lin

(10) Patent No.: US 8,269,676 B2
(45) Date of Patent: Sep. 18, 2012

(54) DUAL-BAND ANTENNA AND PORTABLE WIRELESS COMMUNICATION DEVICE EMPLOYING THE SAME

(75) Inventor: Hsien-Chang Lin, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 498 days.

(21) Appl. No.: 12/536,313

(22) Filed: Aug. 5, 2009

(65) Prior Publication Data

US 2010/0149048 A1 Jun. 17, 2010

(30) Foreign Application Priority Data

Dec. 16, 2008 (CN) ..... 2008 1 0306281

(51) Int. Cl.
*H01Q 1/24* (2006.01)
*H01Q 1/38* (2006.01)
*H01Q 13/10* (2006.01)

(52) U.S. Cl. ..... 343/702; 343/700 MS; 343/767

(58) Field of Classification Search ..... 343/727, 343/729, 730, 770, 771, 700 MS, 795, 702, 343/767

See application file for complete search history.

(56) References Cited

U.S. PATENT DOCUMENTS

| | | | | |
|---|---|---|---|---|
| 4,371,877 | A * | 2/1983 | Doussot et al. | 343/770 |
| 5,489,913 | A * | 2/1996 | Raguenet et al. | 343/767 |
| 5,714,961 | A * | 2/1998 | Kot et al. | 343/769 |
| 6,043,786 | A * | 3/2000 | Vannatta et al. | 343/770 |
| 6,046,703 | A * | 4/2000 | Wang et al. | 343/795 |
| 7,646,341 | B1 * | 1/2010 | Lin et al. | 343/700 MS |
| 2007/0024515 | A1 * | 2/2007 | Suh | 343/767 |

* cited by examiner

*Primary Examiner* — Jacob Y Choi
*Assistant Examiner* — Hasan Islam
(74) *Attorney, Agent, or Firm* — Altis Law Group, Inc.

(57) ABSTRACT

An exemplary dual-band antenna includes a first antenna unit and a second antenna unit for receiving /sending radio frequency signals corresponding generating a low resonant frequency and a high resonant frequency. The first antenna unit is perpendicularly connected to the second antenna unit. The second antenna unit includes a feed portion, two slots, two gaps and two grounding sheets. The feed portion is electrically connected to the first antenna unit and is used to receive radio frequency signals. The slots are adjacent to one side of the first antenna unit and are defined at the both sides of the feed portion, and the slots are connected with the feed portion and used to radiate radio frequency signals. The gaps extend away from a position of the first antenna unit and are defined at the both sides of the feed portion, and each gap communicates with corresponding slot. The grounding sheets are symmetrically positioned at both sides of the feed portion.

15 Claims, 5 Drawing Sheets

DUAL-BAND ANTENNA AND PORTABLE WIRELESS COMMUNICATION DEVICE EMPLOYING THE SAME

BACKGROUND

1. Technical Field

The disclosure relates to antennas for portable wireless communication devices, particularly, to a dual-band antenna which can provide dual frequency bands and a portable wireless communication device employing the dual-band antenna.

2. Description of Related Art

Antennas are important components of portable wireless communication devices, such as mobile phones and personal digital assistants (PDAs). The antennas are used to send and receive radio frequency signals. Today, most of the wireless communication devices use dual-band antennas or multi-band antennas to replace former single-band antenna for improving communicating quality. Referring to FIG. 5, a typical dual-band antenna 1 often includes a first radiation unit 11 and a second radiation unit 12. One end of the second radiation unit 12 is electrically connected to the first radiation unit 11, and the other end of the second radiation unit 12 is connected to the ground (GND). The first radiation unit 11 includes a first radiation part 111 and a second radiation part 112. The first radiation part 111 and the second radiation unit 12 together generate an antenna harmonic in a high frequency, and the second radiation part 112 and the second radiation unit 12 together generate an antenna harmonic in a low frequency.

Although the dual-band antenna 1 can operate in a dual-band, because the radiation units 11 and 12 of the dual-band antenna 1 share a grounding end, and the second radiation unit 12 is shared to generate the high frequency and the low frequency. Thereby, the size of the first radiation part 111 and the second radiation part 112 determines work bands of the dual-band antenna 1, so if the size of the first radiation part 111 or the second radiation part 112 is adjusted, then the size of the second radiation unit 12 need to be adjusted at the same time. Therefore, it is difficult for the dual-band antenna to have an independent and non-interferential resonant frequency, and also it is difficult to adjust the bandwidth.

Therefore, there is a room for improvement within the art.

BRIEF DESCRIPTION OF THE DRAWINGS

Many aspects of a dual-band antenna and a portable wireless communication device employing the dual-band can be better understood with reference to the following drawings. The components in the drawings are not necessarily to scale, the emphasis instead being placed upon clearly illustrating the principles of the present dual-band antenna and a portable wireless communication device employing the dual-band antenna. Moreover, in the drawings, like reference numerals designate corresponding parts throughout the several views.

DETAILED DESCRIPTION OF THE EMBODIMENTS

Figure 1:
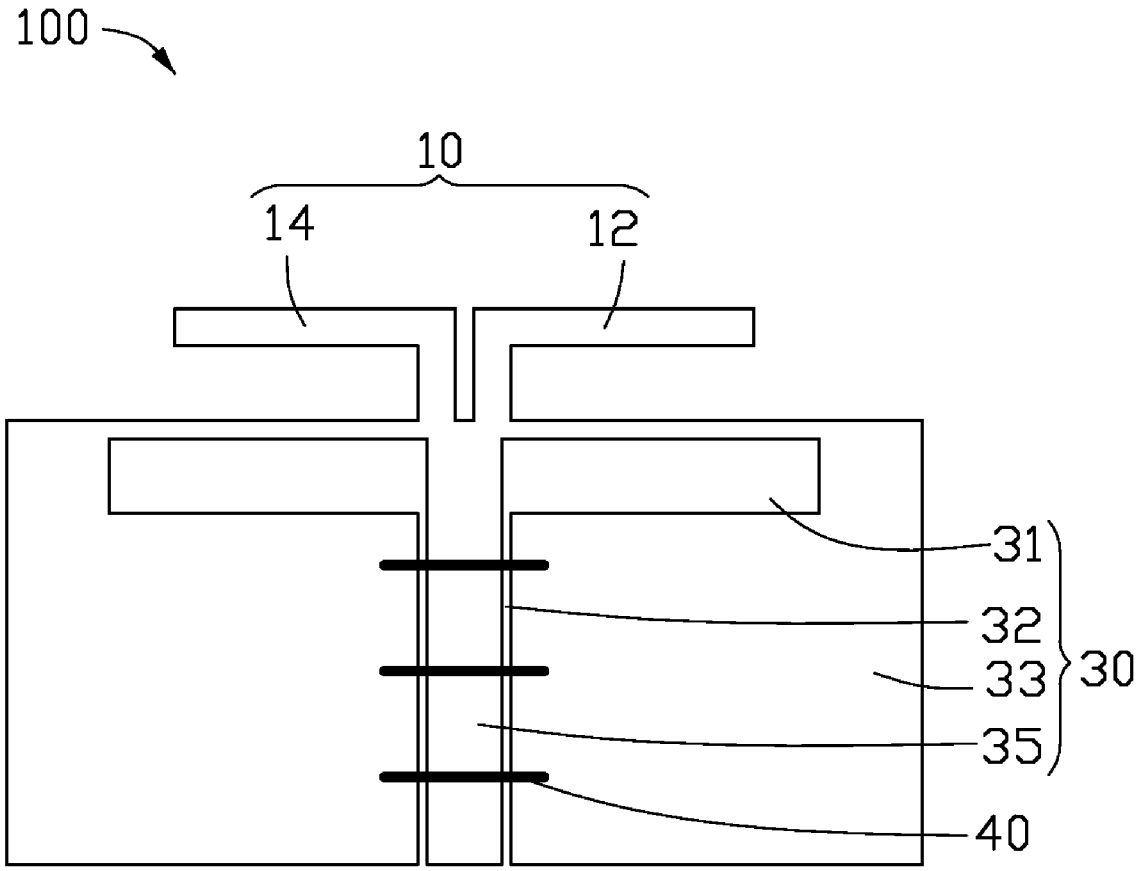
FIG. 1 is a schematic view of a dual-band antenna, according to an exemplary embodiment.
Figure 2:
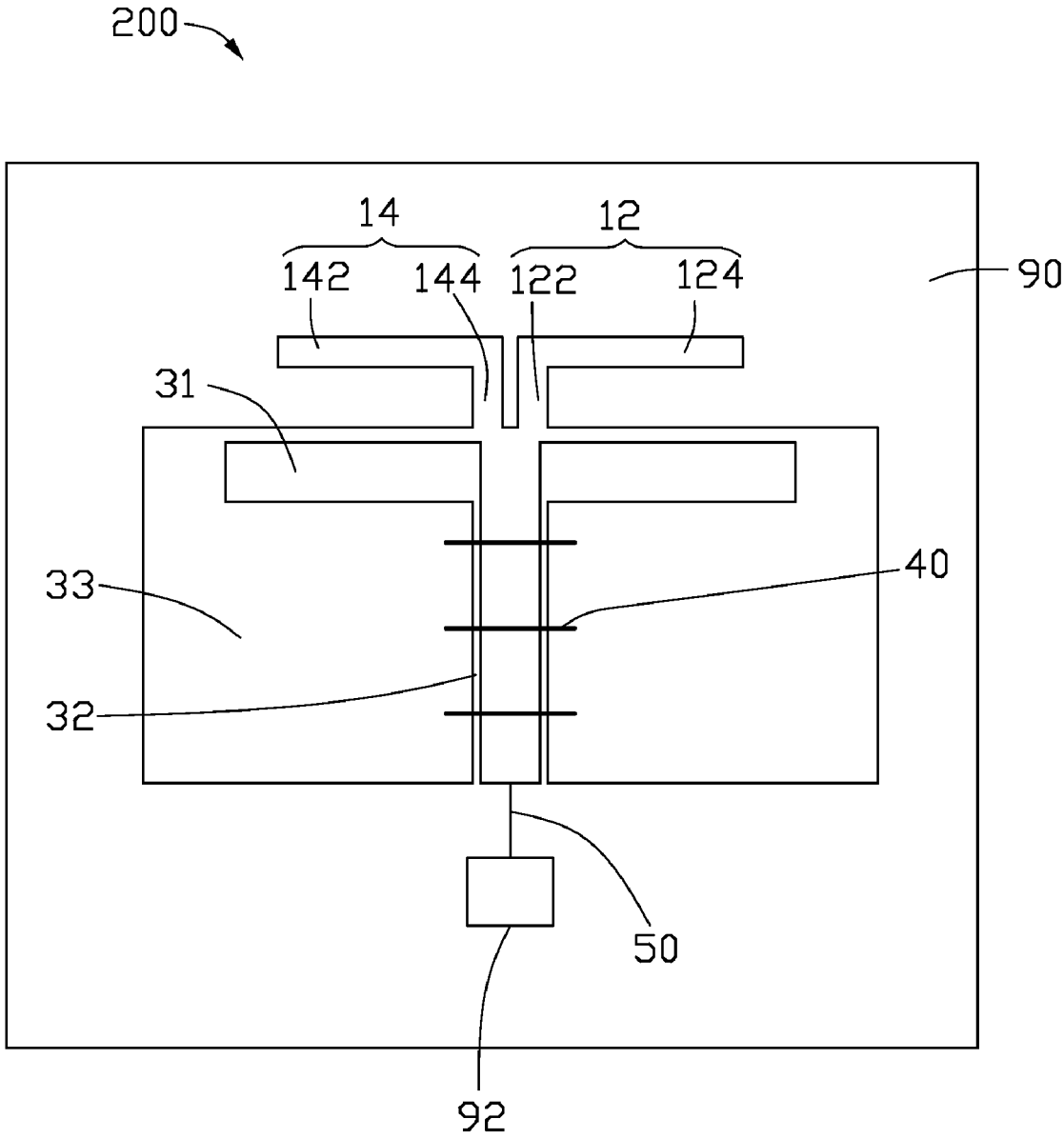
FIG. 2 is a schematic view of the dual-band antenna shown in FIG. 1 mounted on a substrate.

Referring to FIGS. 1-2, the disclosure relates to a dual-band antenna 100 according to an exemplary embodiment. In use, the dual-band antenna 100 is installed in a portable wireless communication device 200, such as a mobile phone or a PDA, to receive and/or send wireless signals. The dual-band antenna 100 is a dual-band coplanar waveguide-fed (CPW-fed) hybrid antenna. The dual-band antenna 100 is mounted on a substrate 90 of the wireless communication device 200 and is electronically connected to the substrate 90. The substrate 90 can be a printed circuit board (PCB) of the wireless communication device 200. The substrate 90 includes a signal incepting point 92 and two grounding points (not shown). The signal incepting point 92 is used to receive and/or send the radio signals. The grounding points are sheets of conductive material, such as metal, and the dual-band antenna 100 is connected to the GND via the grounding points.

The dual-band antenna 100 is made of conductive materials, such as copper or other metals. The dual-band antenna 100 includes a first antenna unit 10 and a second antenna unit 30 connected to the first antenna unit 10. The first antenna unit 10 and the second antenna unit 30 can be made as a whole, and generate a coupling effect via mutual inductance. The first antenna unit 10 is used to receive and/or send wireless signals having low frequencies and the second antenna unit 30 is used to receive and/or send wireless signals having high frequencies.

The first antenna unit 10 is a double "L"-shaped monopole antenna used to transmit low frequency radio signals, and the resonant frequency of the first antenna unit 10 is 2.4 Giga Hertz (GHz). The first antenna unit 10 includes a first radiation member 12 and a second radiation member 14, and both the first radiation member 12 and the second radiation member 14 are uniform in size and shape. The first radiation member 12 includes a first sheet body 122 and a second sheet body 124; the first sheet body 122 has the same width with the second sheet body 124, and is perpendicular to the second sheet body 124. The second radiation member 14 includes a third sheet body 142 and a fourth sheet body 144, the third sheet body 142 also has the same width with the fourth sheet body 144, and is perpendicular with the fourth sheet body 144. The lengths of the second sheet body 124 and the third sheet body 142 are greater than the height of the first sheet body 122 and the fourth sheet body 144. The first sheet body 122 is parallel with the fourth sheet body 144, and both the first sheet body 122 and the fourth sheet body 144 are perpendicularly connected to the second antenna unit 30. The second sheet body 124 and the third sheet body 142 are at the same horizontal level and respectively perpendicular with one end of the first sheet body 122 and the fourth sheet body 144 in the opposite direction. Both the second sheet body 124 and the third sheet body 142 are parallel with the second antenna unit 30. The semi-perimeter of the first radiation member 12 or the second radiation member 14 is about equal to a quarter of the low frequency wavelength. Therefore, the first radiation member 12 and the second radiation member 14 can generate low-frequency radio signal via the coupling resonance.

The second antenna unit 30 is a CPW inductance slot antenna. The second antenna unit 30 has a rectangular sheet-shape and the resonant frequency of the second antenna unit 30 is 5.4 GHz. The second antenna unit 30 defines two slots 31 and two gaps 32 therein, and the two rectangular slots 31 are adjacent to one side of the first antenna 10. The gaps 32 are parallel with each other, the gaps 32 extend away from a perpendicular position of the first antenna unit 10 and each of gaps 32 communicates with corresponding slots 31. The second antenna unit 30 includes two grounding sheets 33 and a feed portion 35. The gaps 32, the slots 31 and the grounding sheets 35 are symmetrically set at the both sides of the feed portion 35, and the grounding sheets 33 and the feed portion 35 are spaced by the gaps 32.

Each slot 31 is adjacent to the grounding sheets 33. In the embodiment, when the second antenna 30 sends and/or receives radio frequency signals, the vicinity of each slot 31 has a greater current that radiates high frequency signals. The longer edge of each slot 31 is parallel with the second sheet body 124 and the third sheet body 142. The length of each slot 31 is about equal to a half of the high-frequency wavelength.

The two grounding sheets 33 have an approximately rectangular sheet-shape and are connected to the grounding point of the substrate 90. The two grounding sheets 33 interconnect via a plurality of bonding wires 40, so that the two grounding sheets 33 have the same electric potential.

The feed portion 35 has an approximately rectangular sheet-shape and is electrically connected to the radiation members 12 and 14. The feed portion 35 is perpendicular with the second sheet body 124 and the third sheet body 142. The feed portion 35 is positioned between the gaps 32. The feed portion 35 is electrically connected with the signal incepting point 92 of the substrate 90 via a feed wire 50, and the resistance value of the feed wire 50 is about 50 ohms. The feed portion 35 is used to send radio frequency signals to the first antenna unit 10 and the second antenna unit 30.

Figure 3:
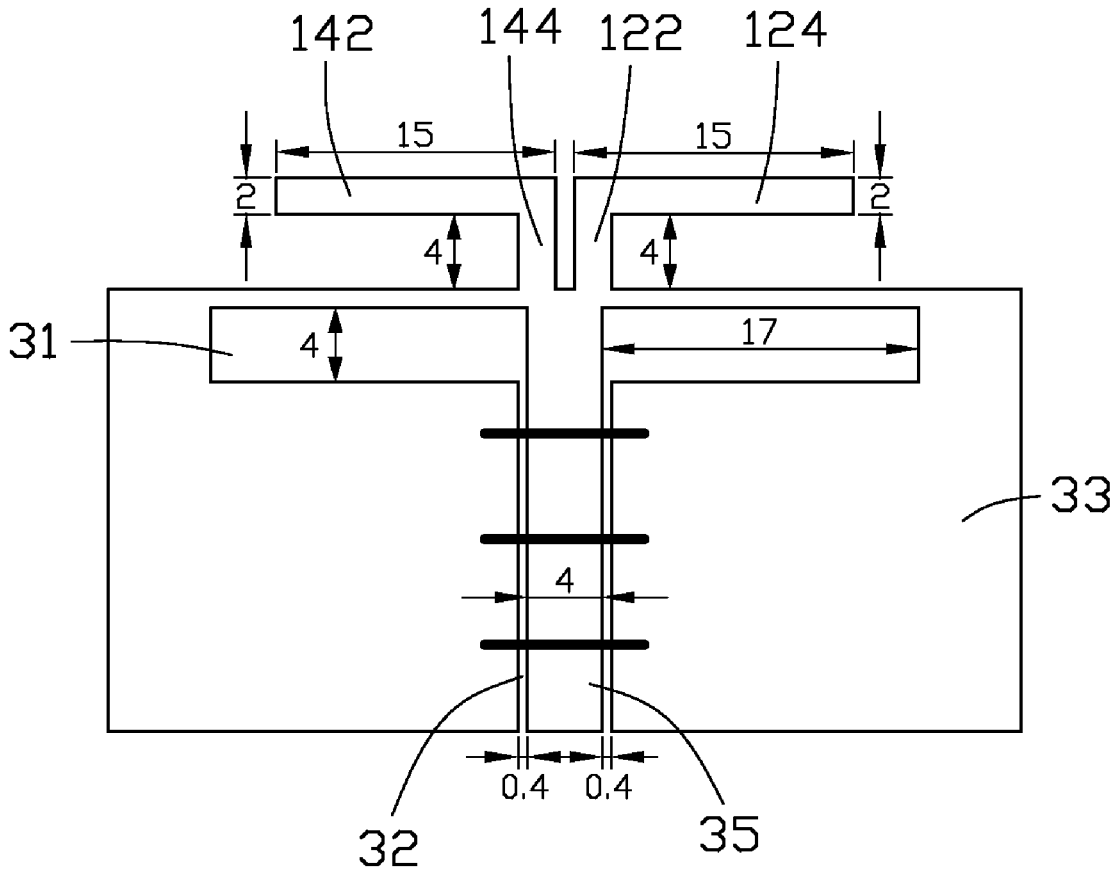
FIG. 3 is a schematic view of the dual-band antenna shown in FIG. 1, having size information.

Also referring to FIG. 3, in the present exemplary embodiment, the height of the first sheet body 122 and the fourth sheet body 144 is about 4 millimeter (mm). The length of the second sheet body 124 and the third sheet body 142 is about 15 mm. The width of the first sheet body 122, the second sheet body 124, the third sheet body 142 and the fourth sheet body 144 is about 2 mm. The length of each slot 31 is about 17 mm, and the width of the slot 31 is 4 mm. According to the nature of the CPW inductive slot antenna, the length of the slots 31 is about equal to halt wavelength of the high frequency wave. The width of the feed portion 35 is about 4 mm, and the width of the each gap 32 is about 0.4 mm.

When the dual-band antenna 100 is in use, the feed portion 35 receives the outer signals and transmits the signals through the first antenna unit 10 and the second antenna unit 30 to form transmission routes of different lengths to operate at about 2.4 GHz and about 5.4 GHz. Moreover, the slots 31 are respective parallel to the second sheet body 124 and the third sheet body 142 in an appropriate distance, Thus, the radiation of the second sheet body 124 and the third sheet body 142 can be enhanced through the coupling with the slots 31.

Figure 4:
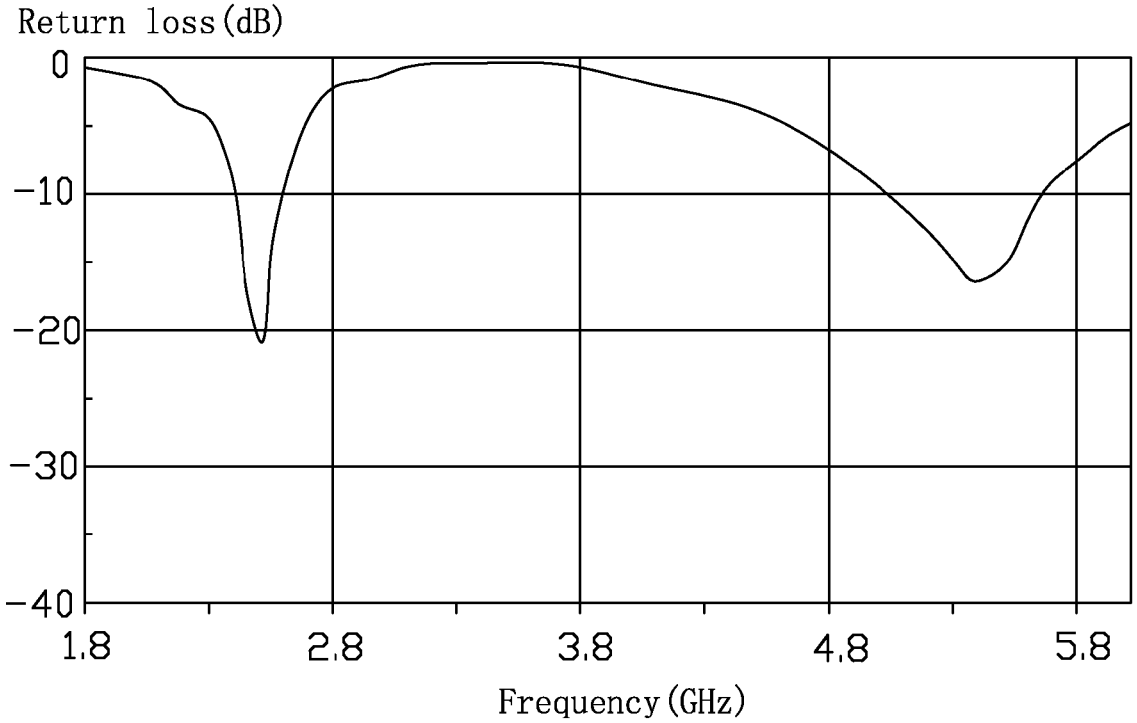
FIG. 4 is a graph of a test result and simulated result obtained from the dual-band antenna of FIG. 1, disclosing return loss varying with frequency.
Figure 5:
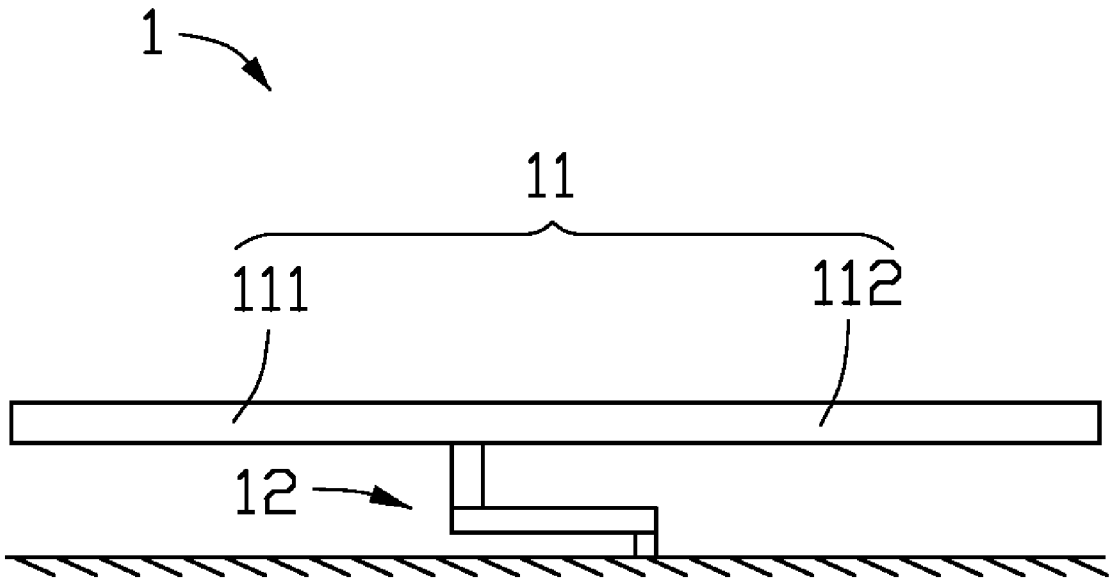
FIG. 5 (RELATED ART)
FIG. 5 is a schematic view of a typical dual-band antenna.

FIG. 4 shows an exemplary test graph of the dual-band antenna 100, disclosing return loss varying with frequency. The horizontal axis of the test graph is expressed as the frequency, and the vertical axis of the test graph is expressed as the return loss. The dual-band antenna 100 generates two resonant frequencies during the test. The two resonant frequencies include a high frequency and a low frequency that increase the bandwidth of the dual-band antenna 100. When the return loss is less than or equal to −10 decibels (dBs), all the frequencies can be used as working frequencies of the dual-band antenna 100. When the dual-band antenna 100 operates at the frequencies 2.4 GHz and 5.4 GHz, the return losses are about corresponding −21 dB and −17 dB.

The first antenna unit 10 and the second antenna unit 30 can have a coupling effect, so that the radiation effects of the first antenna unit 10 are enhanced in the low frequency. The electric fields of the first antenna unit 10 and the second antenna unit 30 are orthogonal, so that the high frequency band and the low frequency band have its own resonant frequencies such that the bandwidths of the first antenna unit 10 and the second antenna unit 30 can be adjusted independently. For example, if the parameters of the first antenna unit 10 are adjusted, then the resonant frequency or bandwidth of the second antenna unit 30 cannot be affected.

Finally, it is to be understood, however, that even though numerous characteristics and advantages of the present invention have been set forth in the foregoing description, together with details of the structure and function of the present invention, the disclosure is illustrative only, and changes may be made in detail, especially in matters of shape, size, and arrangement of parts within the principles of present invention to the full extent indicated by the broad general meaning of the terms in which the appended claims are expressed.

What is claimed is:

1. A dual-band antenna for a portable wireless communication device, comprising:

a first antenna unit for receiving and/or sending radio frequency signals generating a low resonant frequency, the first antenna unit comprising:

a first radiation member for generating radio signal; and a second radiation member for generating radio signal; and a second antenna unit for receiving and/or sending radio frequency signals generating a high resonant frequency, and the second antenna unit connected to the first antenna unit, the second antenna unit comprising:

a feed portion receiving radio frequency signals and electrically connected to the first radiation member and the second radiation member;

two slots being adjacent to one side of the first antenna unit and symmetrically defined at two sides of the feed portion;

two gaps being parallel with each other, extending away from the first antenna unit, symmetrically defined at two sides of the feed portion and each gap communicating with one corresponding slot; and two grounding sheets symmetrically positioned at two sides of the feed portion;

wherein both the first radiation member and the second radiation member are L-shaped plates and are symmetric on the feed portion, and the first radiation member and the second radiation member are coplanar with the second antenna unit.

2. The dual-band antenna as claimed in claim 1, wherein the first radiation member includes a first sheet body and a second sheet body perpendicularly connected to one end of the first sheet body, and another end of the first sheet body is perpendicularly connected to one side of the second antenna unit, and the first sheet body has the same width with the second sheet body.

3. The dual-band antenna as claimed in claim 2, wherein the second radiation member includes a third sheet body and a fourth sheet body perpendicularly connected to one end of the third sheet body, another end of the third end is parallel with one side of the second antenna unit, and the third sheet body has the same width with the fourth sheet body.

4. The dual-band antenna as claimed in claim 3, wherein the lengths of the second sheet body and the third sheet body are greater than the height of the first sheet body and the fourth sheet body, the first sheet body is parallel with the fourth sheet body, and the second sheet body and the third sheet body are at the same horizontal level and extending in the opposite direction.

5. The dual-band antenna as claimed in claim 3, wherein the first antenna unit and the second antenna unit are made as a whole.

6. The dual-band antenna as claimed in claim 1, wherein the grounding sheets have rectangular sheet-shapes and the slots have rectangular shapes, and the grounding sheets and the feed portion are spaced by the gaps.

7. The dual-band antenna as claimed in claim 1, wherein the first antenna unit and the second antenna unit share the grounding sheets and the feed portion cooperatively.

8. The dual-band antenna as claimed in claim 1, wherein the semi-perimeter of the first radiation member or the second radiation member is about equal to a quarter of the low frequency wavelength to determine one resonant frequency in a low band, and the slots generates another resonant frequency in a high band, and length of the slot determines the resonant frequency working in a high band.

9. A portable wireless communication device comprising:

a substrate comprising a signal incepting point for receiving and/or sending radio frequency signals; and a dual-band antenna mounted on the substrate, comprising:

a first antenna unit for receiving and/or sending radio frequency signals generating a low resonant frequency,. the first antenna unit comprising:

a first radiation member; and a second radiation member; and a second antenna unit for receiving and/or sending radio frequency signals generating a high resonant frequency, and the second antenna unit connected to the first antenna unit, the second antenna unit comprising:

a feed portion electronically connected with the signal incepting point for receiving radio frequency signals, and electrically connected to the first radiation member and the second radiation member;

two slots being adjacent to one side of the first antenna unit and symmetrically defined at two sides of the feed portion;

two gaps being parallel each other, extending away from a position of the first antenna unit, symmetrically defined at two sides of the feed portion and each gap communicating with corresponding slot; and two grounding sheets symmetrically positioned at two sides of the feed portion;

wherein both the first radiation member and the second radiation member are L-shaped plates and are symmetry on the feed portion, and the first radiation member and the second radiation member are coplanar with the second antenna unit.

10. The portable wireless communication device as claimed in claim 9, wherein the first antenna unit is a double "L"-shaped monopole antenna and the second antenna unit is a CPW inductive slot antenna.

11. The portable wireless communication device as claimed in claim 9, wherein the first antenna unit and the second antenna unit are made as a whole.

12. The portable wireless communication device as claimed in claim 9, wherein the grounding sheets have rectangular sheet-shapes and the slots have rectangular shapes; the grounding sheets and feed portion are spaced by the gaps.

13. The portable wireless communication device as claimed in claim 9, wherein the first antenna unit and the second antenna unit share the grounding sheets and the feed portion cooperatively.

14. The portable wireless communication device as claimed in claim 9, wherein the semi-perimeter of the first radiation member or the second radiation member is about equal to a quarter of the low frequency wavelength to determine one resonant frequency in a low band, and the slots generates another resonant frequency in a high band, and length of the slot determines the resonant frequency working in a high band.

15. The portable wireless communication device as claimed in claim 9, wherein further including a plurality of bonding wires, the bonding wires are used to connect the two grounding sheets to have the same electric potential.

* * * * *